US008727143B2

(12) United States Patent
Flickinger

(10) Patent No.: US 8,727,143 B2
(45) Date of Patent: May 20, 2014

(54) SPORTS APPAREL ORGANIZER

(71) Applicant: Brent D Flickinger, Copley, OH (US)

(72) Inventor: Brent D Flickinger, Copley, OH (US)

( * ) Notice: Subject to any disclaimer, the term of this patent is extended or adjusted under 35 U.S.C. 154(b) by 0 days.

(21) Appl. No.: 13/738,817

(22) Filed: Jan. 10, 2013

(65) Prior Publication Data

US 2013/0126453 A1 May 23, 2013

Related U.S. Application Data

(63) Continuation-in-part of application No. 11/879,427, filed on Jul. 17, 2007, now Pat. No. 7,959,018, and a continuation of application No. 13/101,100, filed on May 4, 2011, now abandoned.

(51) Int. Cl.

| | |
|---|---|
| ***A47F 7/00*** | (2006.01) |
| ***A47G 29/00*** | (2006.01) |
| ***A47F 7/06*** | (2006.01) |
| ***A47G 25/10*** | (2006.01) |
| ***A47G 25/32*** | (2006.01) |

(52) U.S. Cl.

CPC . *A47F 7/06* (2013.01); *A47G 25/10* (2013.01); *A47G 25/32* (2013.01)

USPC ..... 211/85.3; 211/30

(58) Field of Classification Search

CPC ..... A47F 7/06; A47G 25/10; A47G 25/06; A47G 25/0628; A47G 25/14; A47G 25/32; A47B 61/003; A47B 61/02; A47C 7/64; B60R 7/10; A42C 3/00; A42C 3/04; A42C 3/06; B65D 85/18

USPC ..... 211/85.3, 87.01, 30–33, 85.11, 13.1, 211/181.1, 86.01, 96–102, 119.004, 211/119.009; 206/8, 9; D6/315, 320; 223/7, 223/12, 24; 248/309.1

See application file for complete search history.

(56) References Cited

U.S. PATENT DOCUMENTS

| | | | | | |
|---|---|---|---|---|---|
| 318,657 | A | * | 5/1885 | Richards | 211/106.01 |
| 366,608 | A | * | 7/1887 | Raymond | 211/32 |
| 394,637 | A | * | 12/1888 | Baker | 223/88 |
| 446,946 | A | * | 2/1891 | Ingal | 211/32 |
| 547,856 | A | * | 10/1895 | Matthies | 211/32 |
| 577,010 | A | * | 2/1897 | Cundey | 211/32 |
| D29,729 | S | * | 11/1898 | Thomas | D6/323 |
| 615,918 | A | * | 12/1898 | Smith | 211/96 |
| 623,727 | A | * | 4/1899 | Magill | 211/30 |
| 751,036 | A | * | 2/1904 | Wichman | 12/53.7 |
| 821,364 | A | * | 5/1906 | Jessel | 211/89.01 |
| 846,956 | A | * | 3/1907 | Shaw | 211/32 |
| 909,114 | A | * | 1/1909 | Pitts | 211/9 |
| 915,393 | A | * | 3/1909 | Walker | 223/90 |
| 946,833 | A | * | 1/1910 | Bake | 211/99 |

(Continued)

*Primary Examiner* — Jennifer E Novosad

(57) ABSTRACT

Providing for a sports equipment organizer that can support, store, display and provide ventilation for a helmet and/or other sports equipment is described herein. By way of example, the sports equipment organizer can comprise a mounting device that can be secured to a surface and to a first end of an extension arm, the extension arm having a second end that can be secured to a mounting arm having a mounting surface, upon which at least one head-ware device can be supported. In various embodiments, disclosed hangers or hanging racks can be suspended or secured to the extension arm to support additional sporting apparel or equipment. Particular embodiments facilitate pumped ventilation of the mounting surface, and rotating or folding the mounting arm or extension arm for compact deployment.

16 Claims, 7 Drawing Sheets

(56) References Cited

U.S. PATENT DOCUMENTS

| | | | | | |
|---|---|---|---|---|---|
| 973,090 | A | * | 10/1910 | Weaver | 211/106 |
| 1,091,812 | A | * | 3/1914 | Corthell | 211/33 |
| 1,124,714 | A | * | 1/1915 | Denning | 211/33 |
| 1,143,693 | A | * | 6/1915 | Down | 211/89.01 |
| 1,171,198 | A | * | 2/1916 | Hellberg | 248/223.21 |
| 1,200,361 | A | * | 10/1916 | Johnson et al. | 211/106 |
| 1,231,635 | A | * | 7/1917 | Nelson | 211/33 |
| 1,333,600 | A | * | 3/1920 | Bell | 248/290.1 |
| 1,387,765 | A | * | 8/1921 | Colonna | 211/168 |
| 1,390,372 | A | * | 9/1921 | Miller | 211/32 |
| 1,393,843 | A | * | 10/1921 | Smith | 211/32 |
| 1,427,260 | A | * | 8/1922 | Catlin | 248/303 |
| 1,782,302 | A | * | 11/1930 | Harvey | 211/32 |
| 1,837,692 | A | * | 12/1931 | Thomas | 211/32 |
| 1,926,201 | A | * | 9/1933 | Kahns | 211/32 |
| 1,965,773 | A | * | 7/1934 | Jacobs | 211/32 |
| 1,970,943 | A | * | 8/1934 | Raymond | 223/94 |
| 1,984,827 | A | * | 12/1934 | Derman | 312/4 |
| 2,025,437 | A | * | 12/1935 | Brown | 211/32 |
| 2,094,810 | A | * | 10/1937 | Oppenheimer | 211/33 |
| 2,310,439 | A | * | 2/1943 | Johnson | 211/32 |
| D151,372 | S | * | 10/1948 | Keefer | D6/317 |
| 2,631,734 | A | * | 3/1953 | Hartley | 211/32 |
| 2,709,004 | A | * | 5/1955 | Dahlstrom | 108/20 |
| 2,931,513 | A | * | 4/1960 | Cignoli | 211/35 |
| 3,532,225 | A | * | 10/1970 | Reed | 211/181.1 |
| 3,740,013 | A | * | 6/1973 | Bentley et al. | 223/66 |
| 4,109,335 | A | * | 8/1978 | Randolph | 12/123 |
| 4,310,096 | A | * | 1/1982 | Kohlhepp | 211/87.01 |
| 4,583,646 | A | * | 4/1986 | Bowman | 211/32 |
| 5,002,190 | A | * | 3/1991 | Moreland | 211/32 |
| 5,662,301 | A | * | 9/1997 | Fard | 248/315 |
| 6,112,909 | A | * | 9/2000 | Moseley | 211/32 |
| 7,168,577 | B1 | * | 1/2007 | Moseley | 211/32 |
| D568,619 | S | * | 5/2008 | Worrell | D6/317 |

* cited by examiner

SPORTS APPAREL ORGANIZER

CLAIM OF PRIORITY TO RELATED APPLICATIONS

This application for patent is a continuation-in-part of U.S. patent application Ser. No. 11/879,427 entitled "SPORTS APPAREL ORGANIZER" and filed Jul. 17, 2007, and a continuation of U.S. patent application Ser. No. 13/101,100 entitled "SPORTS APPAREL ORGANIZER" and filed May 4, 2011, each of which are hereby incorporated by reference herein in their respective entireties.

BACKGROUND

Sports equipment can often be neglected in between games or events. Trailers, bags, and other equipment suitable for porting sporting gear and apparel are not always sufficient for properly storing such gear and apparel. Additionally, it can be easy to lose track of sporting equipment if it is not transported, stored and/or maintained in a visible location. The inside of a bag or other carrying device may not sufficiently aerate such equipment. Moreover, trailers, garages, closets, etc., where sporting equipment is often stored may not provide sufficient visibility to keep track of such equipment.

Sporting equipment can also be subject to misplacement in between use. Worse still, relatives, children, pets and others can damage, scratch, move, or misplace, etc. sporting equipment. As a result, an improved mechanism for organizing equipment in between matches and events can be useful.

SUMMARY

The following presents a simplified summary of the disclosure in order to provide a basic understanding of some aspects of the full written description. This summary is not an extensive overview of the disclosure. It is not intended to identify key/critical elements of various innovative aspects disclosed herein, or to delineate the scope of the disclosure. Its sole purpose is to present some disclosed innovative aspects in a simplified form as a prelude to the more detailed description that is presented later.

Briefly described, the subject disclosure relates to a sports equipment organizer that can support, store, display and provide ventilation for a helmet and/or other sports apparel such as gloves, a jacket, eyewear, clothing and the like. A mounting device can be attached to a portion of an extension arm and secure the extension arm to a mounting surface. The extension arm can extend substantially perpendicular out from the mounting surface. Additionally, a mounting arm can be attached to and supported by the extension arm, and can securely support at least one head-ware device.

According to additional aspects of the claimed subject matter, one or more accessories are provided with the sports equipment organizer. Such accessories can include one or more hangers adapted to fit snugly and smoothly about the extension arm, for storing sporting apparel such as a jacket, belt, shoulder-pads, or the like. Another accessory can include a hanging rack adapted to support sporting equipment such as a bicycle, skateboard, long and relatively thin equipment such as sticks/bats/poles, etc., or the like. In one aspect, the hanging rack can fit snugly and smoothly about the extension arm, in a similar manner as the one or more hangers. In other aspects, the hanging rack can have fixed support arms, or can have adjustable support arms. In a particular aspect, the hanging rack can comprise a tension coil from which the support arms extend, that enables the support arms to be compressed or expanded to more snugly or more accurately support various sizes of sporting equipment from the support arms.

In a further aspect of the subject disclosure, provided is a sports apparel organizer adapted to provide additional ventilation to a piece of headgear placed atop a mounting surface of the sports apparel organizer. Particularly, the mounting surface can be created with one or more holes through which air can flow to an interior of the headgear. In one particular aspect, air can be pumped up through a mounting arm supporting the mounting surface, causing persistent airflow from the mounting surface to encounter the interior of the headgear. This can provide a significant advantage for ventilating the headgear.

In another aspect of the subject disclosure, a sports apparel organizer is disclosed that can be folded or compacted for convenient storage. For instance, when sporting equipment or apparel is not attached to the sports apparel organizer, a mounting arm thereof can be rotated or folded to be parallel or quasi-parallel to an extension arm thereof (e.g., where the mounting arm and extension arm are separated by an angle that is less than about twenty degrees to be quasi-parallel). In one instance, a mounting surface of the sports apparel organizer can rest against the extension arm, where the mounting arm is folded to be quasi-parallel with the extension arm. In at least one aspect, the sports apparel organizer can be configured with a removable mounting surface, to enable the mounting arm to fold parallel or substantially parallel to the extension arm (e.g., within five degrees or less). In still other aspects, the extension arm can be rotated or folded parallel or close to parallel with a mounting surface of the sports apparel organizer. This enables the sports apparel organizer to be relatively flush with a mounting device or mounting surface associated therewith, to facilitate compact storage, for example.

The following description and the annexed drawings set forth in detail certain illustrative aspects of the claimed subject matter. These aspects are indicative, however, of but a few of the various ways in which the principles of the claimed subject matter may be employed and the claimed subject matter is intended to include all such aspects and their equivalents. Other advantages and distinguishing features of the claimed subject matter will become apparent from the following detailed description of the claimed subject matter when considered in conjunction with the drawings.

DETAILED DESCRIPTION

Figure 1A:
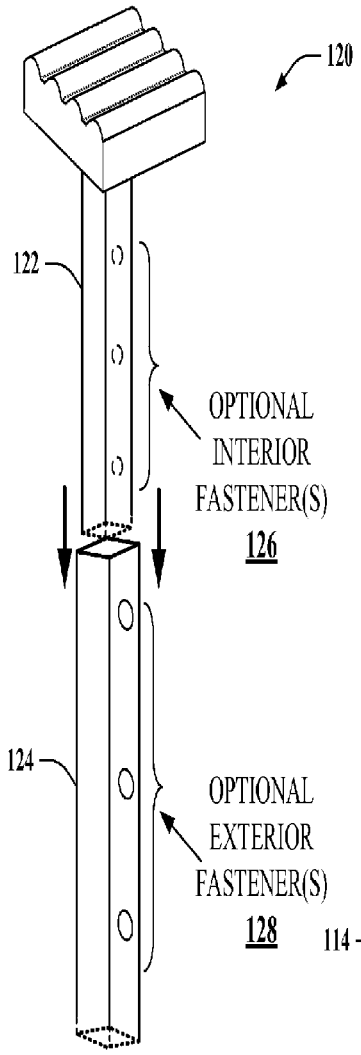
FIG. 1A depicts an alternative embodiment including an apparatus for organizing sports equipment having an adjustable mounting arm.

The claimed subject matter is now described with reference to the drawings, wherein like reference numerals are used to refer to like elements throughout. In the following description, for purposes of explanation, numerous specific details are described in order to provide a thorough understanding of the disclosed subject matter. It can be evident, however, that the disclosed subject matter can be practiced without one or more of these specific details. In addition, it should be appreciated that all possible details within the scope of the subject innovation cannot be specifically articulated or depicted herein. However, such details or embodiments, known in the art or made known to one of skill in the art by way of the context provided herein, are incorporated into the subject specification. In some instances, well-known structures and devices can be shown in block diagram form in order to facilitate describing various disclosed subject matter.

Furthermore, the subject matter disclosed herein may be implemented as a method, apparatus, or article of manufacture using standard manufacturing and/or engineering techniques to produce the disclosed subject matter. Of course, those skilled in the art will recognize many modifications can be made to this configuration without departing from the scope or spirit of the subject disclosure. In addition, the word "exemplary", where used herein, means serving as an example, instance, or illustration. Any aspect or design described herein as "exemplary" is not necessarily to be construed as preferred or advantageous over other aspects or designs. Rather, use of the word exemplary is intended to present concepts in a concrete fashion.

As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Figure 1:
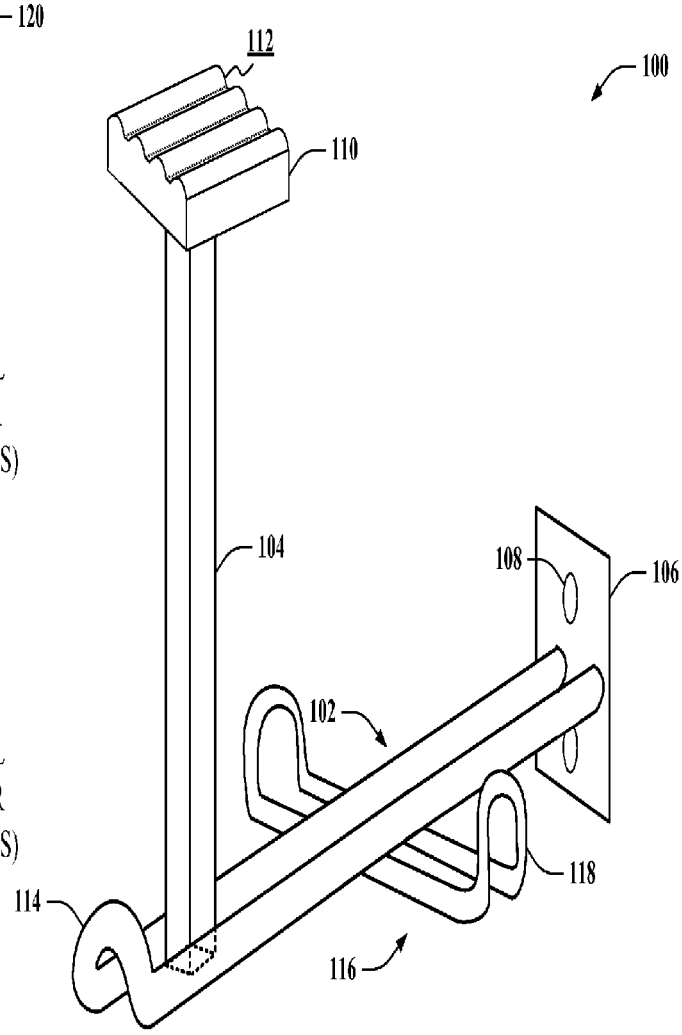
FIG. 1 illustrates an example apparatus configured for organizing sporting equipment in accordance with aspects of the subject disclosure.

Referring now to FIG. 1 an apparatus 100 is depicted for storing or securing a headgear (e.g., a helmet—not depicted) in accordance with aspects of the subject disclosure. Apparatus 100 can comprise an extension arm 102 connected to a mounting arm 104, and connected to a mounting device 106. Extension arm 102 can be fabricated according to various fabrication methods. In one example, extension arm 102 can be a single length of substantially rigid material, fastened to mounting device 108 at a first end of its length, or a length of substantially rigid material can be bent substantially in half to form a length of substantially rigid material comprising two portions that are parallel or substantially parallel to each other. This latter embodiment is depicted in FIG. 1, although the subject disclosure is not limited to this example depiction.

Mounting arm 104 can be connected to extension arm 102 near or at a second end of extension arm 102. In one example embodiment, mounting arm 104 can be an extruded solid, or can be an extruded material having a hollow interior. In a particular embodiment, when extension arm 102 comprises two parallel or substantially parallel segments, mounting arm can be connected at a first end thereof between these segments near the second end of extension arm 102, as depicted in FIG. 1.

In addition to the foregoing, apparatus 100 can comprise a padded seat 110 connected to a second end of mounting arm 104. Padded seat 110 can comprise various padding material, such as rubber, plastic, silicone rubber, foam, foam rubber, fabric, and so on, or a suitable combination thereof. In at least one aspect, padded seat 110 can further comprise one or more bumps or ridges 112 on an upper surface of padded seat 110. An inner portion of a headgear can rest atop the padded seat 110 and ridges 112, where the ridges 112 can facilitate airflow beneath the inner portion of the headgear. This can provide suitable ventilation to the inner portion of the headgear, to allow evaporation of moisture for instance.

Mounting device 106 can comprise a substantially rigid plate material suitable for securing apparatus 100 to a flat surface, or a surface having mild curvature. Additionally, mounting device 106 can comprise means for fastening apparatus 100 to the surface. In one example, means for fastening can include one or more holes 108 through which a suitable fastener can be employed to secure mounting device 106 to the surface. Examples of suitable fasteners can include nails, screws, bolts, and so on.

In a particular embodiment, an end of extension arm 102 opposite from mounting device 106 can be bent away from a longitudinal dimension of extension arm 102 to form a strapping hook or loop 114 (referred to herein as strapping loop 114). Strapping loop 114 can enable a chinstrap or other strap-like device of a headgear (e.g., string, rope, etc.) seated atop padded seat 110 to secure the headgear to apparatus 102. In this fashion, the headgear can be secured tightly to apparatus 100, reducing a likelihood that the headgear will slip or be jolted off of apparatus 100. In this embodiment, apparatus 100 can be mounted (e.g., at mounting device 106) to a surface of a vehicle, such as a trailer, a bed of a truck, trunk of a car, side of a motorcycle, or the like. When the headgear is resting atop padded seat 110 and secured to strapping loop 114, such a vehicle can be in motion and headgear can resist slipping or falling off apparatus 100.

In a further aspect of the subject disclosure, apparatus 100 can comprise an attachment mechanism 116. Attachment mechanism 116 can extend substantially perpendicular from a length of extension arm 102, and can comprise at least one hooking mechanism 118 at an end of attachment mechanism 116. In one aspect of the subject disclosure, attachment mechanism 116 extends perpendicular from only one side of extension arm 102. In another aspect, attachment mechanism can extend bilaterally out from both sides of extension arm 102, as depicted in FIG. 1. In the latter embodiment, attachment mechanism can comprise a hooking mechanism 118 on each end thereof.

According to one or more alternative or additional embodiments of the subject disclosure, an extendable mounting arm 120 is depicted at FIG. 1A. Extendable mounting arm 120 facilitates a mounting arm having a variable length. In this case, extendable mounting arm 120 can be extended or lowered to change a length of extendable mounting arm 120, positioning padded seat 110 closer or further from extension arm 102, as desired, from a minimum length of extendable mounting arm 120 to a maximum length thereof. Further, extendable mounting arm 120 can be fixed to a selected length via a fixing mechanism. In one aspect, extendable mounting arm 120 can comprise an inner segment 122 and an outer segment 124, where the inner segment 122 can slide within the outer segment 124 to adjust the length of extendable mounting arm 120. In this aspect, the fixing mechanism can optionally comprise one or more interior fasteners 126 or one or more exterior fasteners 128. Suitable fastener(s) for interior fastener(s) 126 or exterior fastener(s) 128 can include a pin(s), a rod(s), or other rigid devices that can be inserted into matching holes (for the matching exterior fastener(s) 128 or interior fastener(s) 126) of the inner segment 122 and outer segment 124 to fix the length of extendable mounting arm 120. In another aspect, the fixing mechanism can comprise a spherical or partially spherical bearing (interior fastener(s) 126) secured to the inner segment 122 at least in part with a spring mechanism. When a hole (exterior fastener(s) 128) of the outer segment 124 fits over the bearing, the spring can exert outward pressure on the bearing, pushing the bearing at least partially through the hole of the outer segment, thereby fixing a position of the outer segment 124 and inner segment 122 relative to each other, to fix the length of the extendable mounting arm 120. In this aspect, the outer segment 124 can have a plurality of holes of similar diameter (exterior fastener (s) 128) as the bearing (interior fastener(s) 126) along a length of the outer segment 124, providing a plurality of points along the length of the outer segment 124 to which the outer segment 124 can be fixed to the inner segment 122. Other mechanisms known in the art, or made known to one of skill in the art by way of the context provided herein, for adjusting and securing the length of extendable mounting arm 120 are incorporated into the subject disclosure.

Figure 2:
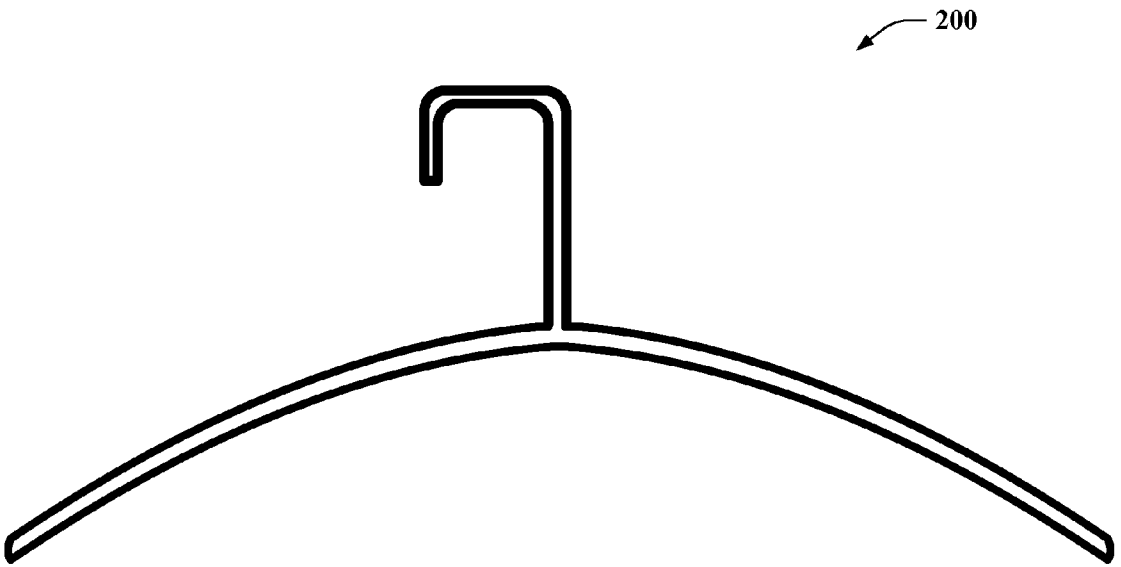
FIG. 2 depicts a sample hanger adapted to support apparel from the apparatus of FIG. 1, or a related apparatus, in accord with one or more additional aspects.

Referring to FIG. 2, an example hanger 200 suitable for use in conjunction with apparatus 100 of FIG. 1, supra, is depicted. Hanger 200 can comprise a hooking mechanism 202 suitable for securing hanger 200 to extension arm 102 of apparatus 100. For instance, hooking mechanism can have a left-side bar that can be positioned on one side of extension arm 102, and a right-side bar 206 that can be positioned at an opposite side of extension arm 102. Further, a distance 'D' between left-side bar 204 and rightside bar 206 can be substantially equivalent to a width of extension arm 102. This can enable hooking mechanism 202 to rest smoothly and snugly atop extension arm 102, with the left-side bar 204 and right-side bar 206 straddling respective sides of extension arm 102.

Additionally, hanger 200 can comprise respective wings 208 that extend bilaterally outward from hooking mechanism 206. Wings 208 can be suitable for supporting one or more articles of clothing. Examples of suitable articles of clothing can include a jacket, a shirt, pair of gloves, shoes (e.g., laces of the shoes being suspended over wings 208), and so on. Further, it is contemplated that a plurality of hangers 200 can be seated atop extension arm 102 concurrently, for hanging multiple articles of clothing. In one instance, hanger 200 can freely slide along a length of extension arm 102. In another instance, a groove(s) or depression(s) on the upper surface of extension arm 102 (not depicted) running perpendicular to a length of extension arm 102 can provide a seat for hanger 200, providing resistance to movement of hanger 200 along the length of extension arm 102.

Figure 3:
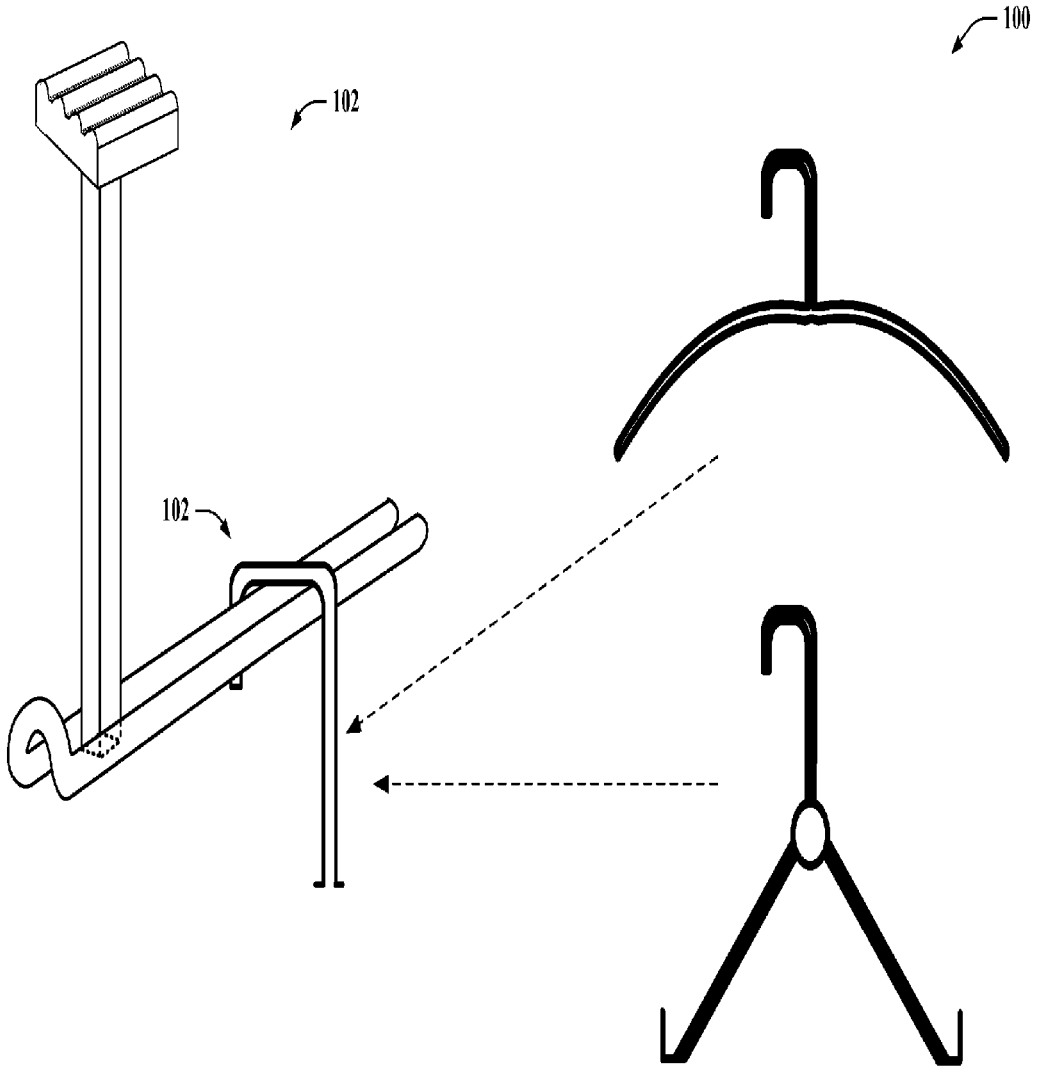
FIG. 3 depicts the sample hanger and an example hanging rack utilized in conjunction with a sports organizer apparatus according to particular aspects.

FIG. 3 depicts one example embodiment 300 of utilizing one or more hanging devices in conjunction with a sports apparel organizer of the subject disclosure. Apparatus 302 can comprise a sports apparel organizer that can be substantially similar to apparatus 100, supra, in one aspect of the subject disclosure. However, apparatus 302 can comprise a subset of features of apparatus 100, or additional features as described in FIG. 2, supra, in other aspects. As depicted, apparatus 302 can comprise an extension arm 303 that can be adapted to extend apparatus 302 substantially perpendicular outward from a mounting surface (not depicted). Further, one or more hangers having respective hooking mechanisms 304 can be seated atop extension arm 303, as depicted. One suitable hanger 304A can be substantially similar to hanger 200 of FIG. 2, supra. Such a hanger could be suitable, for instance, for hanging various apparel such as a jacket, shirt, gloves, shoes, and so on.

In another aspect of the subject disclosure, the hanger can comprise a hanging rack 304B. In one aspect of the subject disclosure, hanging rack 304B can include a hooking mechanism 304 substantially similar to hooking mechanism 206 of FIG. 2. However, hanging rack 304B is not limited to this aspect, as other hooking or hanging mechanisms can be employed instead. According to further aspects, hanging rack 304B can comprise one or more support arms 306, which extend outward and down from a center portion 308 of hanging rack 304B. In one instance, hanging rack 304B can be a solid material (e.g., a metal wire) that can be bent to form center portion 308, support arms 306 and the hooking mechanism. In another aspect, one or more of support arms 306 or hooking mechanism can be attached to center portion 308 (e.g., via fastening, welding, or the like). Alternative embodiments of hanging rack 304B are described in more detail infra, at FIGS. 4 and 5.

Figure 4:
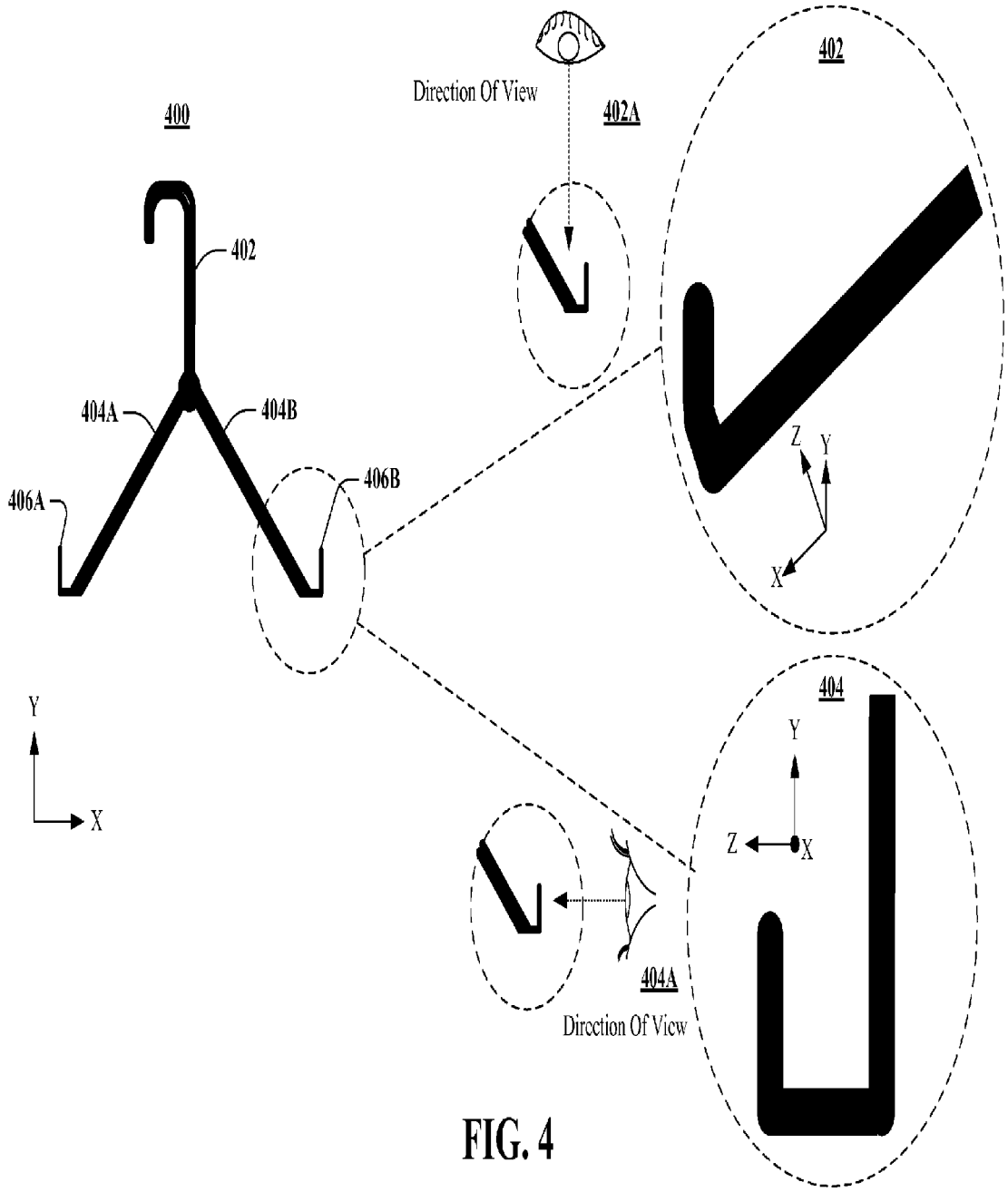
FIG. 4 depicts an example embodiment of a hanging rack adapted to fit with a sports apparel organizer according to the subject disclosure.

FIG. 4 illustrates a diagram of an example hanging rack 400 that can be utilized in conjunction with a sports apparel organizer according to various aspects of the subject disclosure. Hanging rack 400 comprises a hooking mechanism 402 that can be employed to suspend hanging rack 400 from a suitable surface, rod, bar, etc., which extends beneath hooking mechanism 402. In addition, hanging rack can comprise a left support arm 404A ending in a left flange 406A and right support arm 404B ending in a right flange 406B. The respective support arms 404A, 404B and flanges 406A, 406B can be utilized, for suspending hanging various articles, or equipment. Such equipment can include a bicycle, skateboard, shoulder-pad, hockey stick, baseball bat, helmet(s), as well as apparel such as gloves, shoes or boots, clothing, and so on.

Hanging rack 400 is depicted from two sub-viewpoints 402A and 404A, having respective vertical axis 'Y' and horizontal axis 'X' to facilitate illustration of the respective directions of view of the respective viewpoints. Additionally, sub-viewpoints 402A and 404A depict respective 'Z' axis to illustrate depth of hanging rack 400. Hanging rack 400 depicts a frontal view in which the 'Y' axis extends from bottom to top of hanging rack 400, and the 'X' axis extends from left to right. Sub-viewpoint 402A looks downward and slightly behind hanging rack 400, while zooming in on the right flange 406B of support arm 404B. As is depicted, right flange 406B extends outward from support arm 404B along the 'Z' direction, providing space between right flange 406B and support arm 404B. This space can be suitable for resting a piece of equipment (e.g., glove, helmet, boot, etc.), or a portion of a piece of equipment (e.g., one point of a bicycle frame, hockey stick, baseball bat, lacrosse stick, etc.). Sub-viewpoint 404A looks leftward at right flange 406B from the right side of hanging rack 400, along the 'X' axis. From this viewpoint, right flange 406B clearly extends along the 'Y' axis, and is separate from right support arm 404B by the distance described above.

Figure 5:
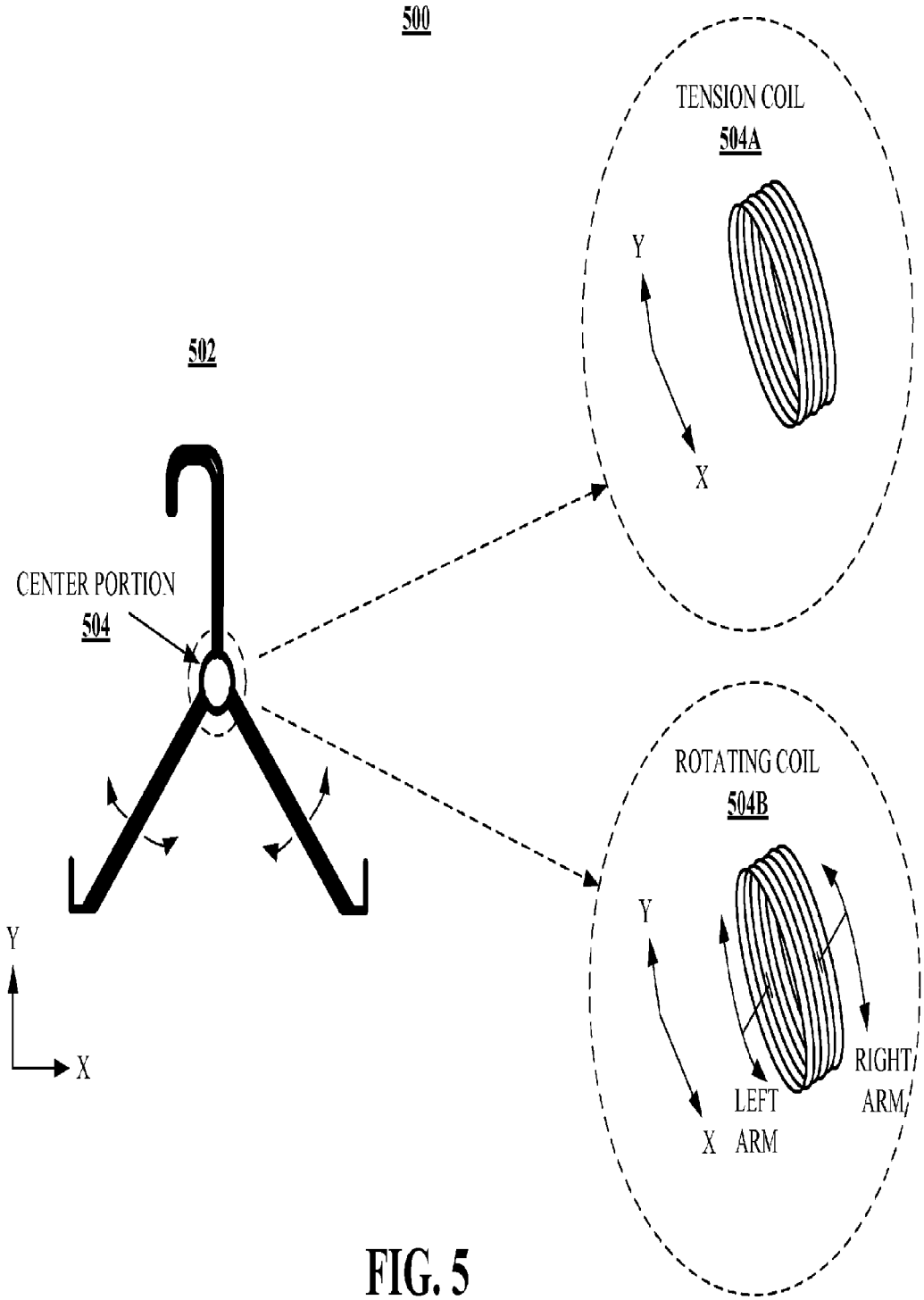
FIG. 5 depicts a sample embodiment of an alternative hanging rack adapted to fit with the sports apparel organizer according to further aspects.

FIG. 5 illustrates a diagram 500 of an alternative embodiment of a hanging rack 502 according to one or more aspects of the subject disclosure. Hanging rack 502 comprises a center portion 504 where a hooking mechanism and two support arms of hanging rack 502 meet. As depicted by FIG. 5, center portion 504 can be a ring or cylinder shape having a hollow middle. In at least one aspect of the subject disclosure, center portion 504 can be fabricated to allow the support arms to move with respect to center portion 504, or with respect to each other. For instance, the support arms can move at least in part rotationally about center portion 504. Two examples facilitating this movement are depicted at respective cutout figures, including a tension coil 504A and a rotating coil 504B.

Tension coil 504A can be employed as center portion 504 in at least one aspect of the subject disclosure. Tension coil 504A comprises coiled wire, or other suitable spring that can be attached to or fabricated in conjunction with the support arms and hooking mechanism of hanging rack 502. Tension coil 504A has a resting position (e.g., no tension imposed on the support arms) when the support arms are at a default position (e.g., as depicted at 502). However, tension coil 504A enables one or more of the support arms to be moved from the default position (e.g., by pushing or pulling a support arm out of the default position). Changing one or more of the support arms from the default position can also change a distance between the support arms, facilitating adaptable support for objects of varying sizes suspended from hanging rack 502. As one illustrative example, a bicycle can be suspended from the two support arms by placing a horizontal bar of the bicycle atop lower flanges of the respective support arms. In As another illustrative example, a skateboard having a wheel axle shorter than a default distance between these lower flanges (when the support arms are in their respective default positions) can be suspended from the support arms by pushing the support arms together (thereby shortening this default distance). This tension coil 504A can exert outward pressure on wheels of the skateboard, providing added force to keep the skateboard in place.

Rotating coil 504B depicts an alternative embodiment of center portion 504. Rotating coil 504B can comprise a set of rings, cylinders, etc., wherein at least one of the rings or cylinders can rotate about center portion 504. In one instance, rotating coil 504B can comprise a housing (not depicted) that holds respective coils of rotating coil 504B in place with respect to a central axis of rotating coil 504B, and that allows the at least one of the rings or cylinders to rotate at least in part about the central axis. One or more of the support arms, or the hooking mechanism, can be connected to or fabricated as part of respective ones of the at least one of the ring or cylinders. Thus, the respective ones of the rings/cylinders enable the corresponding respective support arm or hooking mechanism to rotate about center portion 504. In one specific aspect of the subject disclosure, a locking mechanism can be employed (e.g., a pin, a hook, a brake, etc.) to secure one or more of the rotating rings/cylinders in place, to fix a position of the support arms, or of the hooking mechanism. In this manner, the rotating coil 504B also facilitates adjusting a distance between the support arms, and fixing the distance to a desired distance.

Figure 6:
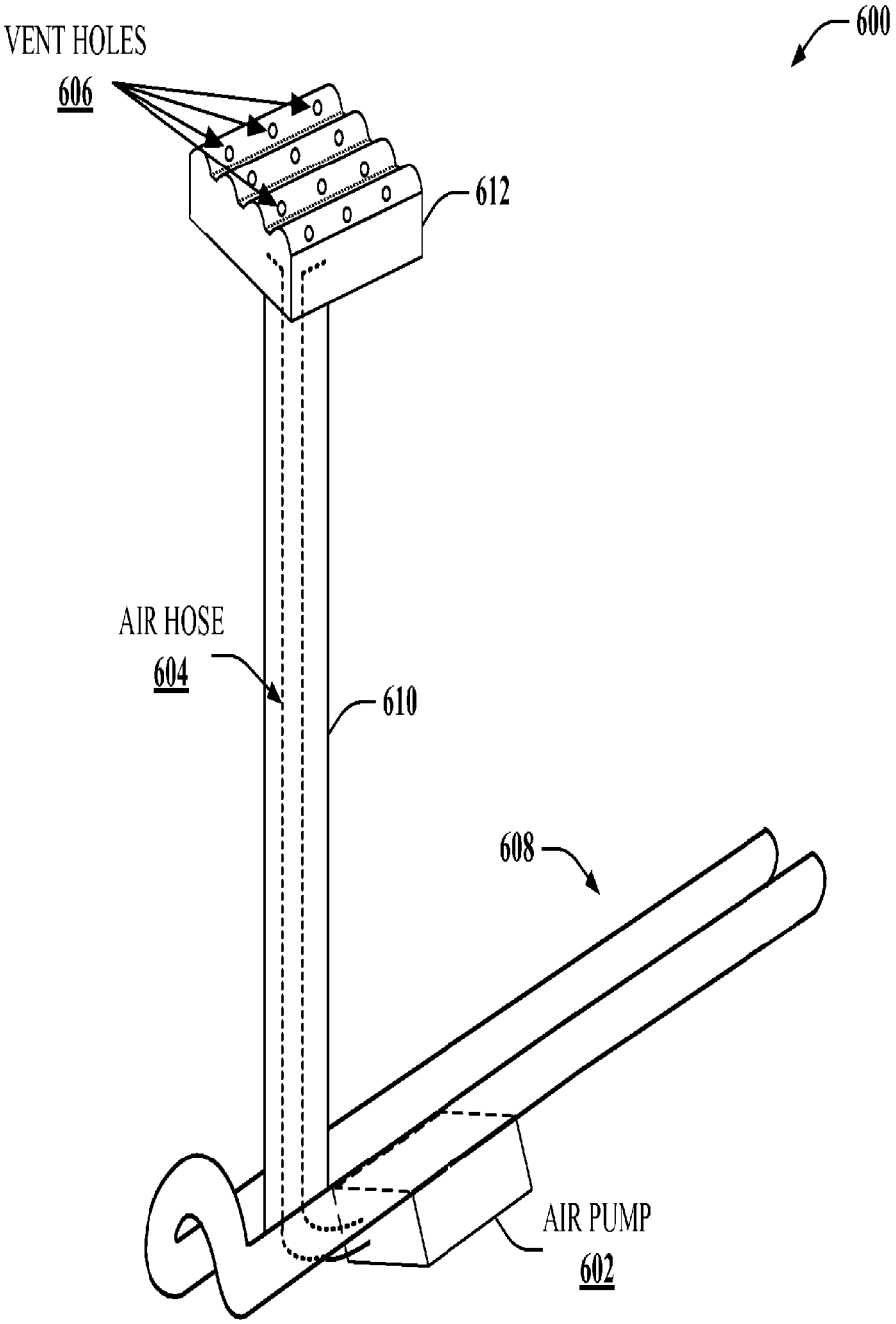
FIG. 6 illustrates a diagram of an example apparatus for providing ventilation to a headgear mounted on the apparatus according to another aspect.

FIG. 6 illustrates a diagram of an apparatus 600 according to one or more further aspects of the subject disclosure. Apparatus 600 can comprise a sports apparel organizer, substantially similar to apparatus 102 of FIG. 1, supra, in at least one aspect of the subject disclosure. However, apparatus 600 is not limited to this aspect(s), and can comprise a subset of the features of apparatus 102, or additional features described herein. In at least one embodiment, apparatus 600 can comprise an extension arm 608 connected to a mounting arm 610 and padded seat 612, for supporting and securing a headgear (e.g., a helmet). Additionally, apparatus 600 can comprise an air pump 602. Air pump 602 can be an electrical or mechanical pump, or a suitable combination thereof, for forcing air through a hose 604 up to padded seat 612. When electrically powered, air pump 602 can run off of AC power or DC power, or both. For instance, air pump 602 can comprise an AC motor and an AC plug and coil (not depicted), that can be plugged into an AC outlet, or other suitable AC power source. In another instance, air pump 602 can comprise a DC motor and one or more suitable DC batteries, or an AC plug and a suitable AC/DC converter. Additionally, air pump 602 can be fastened or otherwise secured to a bottom or top (or side) of extension arm 608, or to mounting arm 610. In one example, air pump 602 can be seated or fastened within a housing (not depicted) that is affixed to extension arm 608 or mounting arm 610. In this example, air pump 602 can be removed from the housing (e.g., for maintenance, repair, changing batteries, or the like), and protected from contact while within the housing.

Hose 604 can extend along an outside of mounting arm 610 to padded seat 612 in one aspect of the subject disclosure, or can extend inside mounting arm 610 in another aspect (e.g., where mounting arm 610 is hollow). Hose 604 can be made of any suitable material for guiding a fluid (e.g., air, or other gas, or a liquid in some aspects) from air pump 602 to padded seat 612. Examples of such material can include suitable plastics, suitable metals, suitable rubbers, and so on.

In addition to the foregoing, padded seat can be configured with one or more vent holes 606. Vent holes can be configured so as to enable a fluid pushed up through hose 604 by air pump 602 to exit at an upper surface of padded seat 612. Thus, an object (e.g., a helmet) positioned on top of padded seat 612 can be exposed to the fluid that is pushed up through hose 604. Thus, where air is pumped up through hose 604, the air can be continually incident upon the object, facilitating enhanced evaporation of moisture, dissipation of odors, and like benefits. Moreover, where padded seat 612 includes ridges or grooves, or the like on an upper surface thereof, air being pumped up and out vent holes 606 can escape out through the ridges/grooves, etc., facilitating continuous air flow to and away from the upper surface of padded seat 612.

Figure 7:
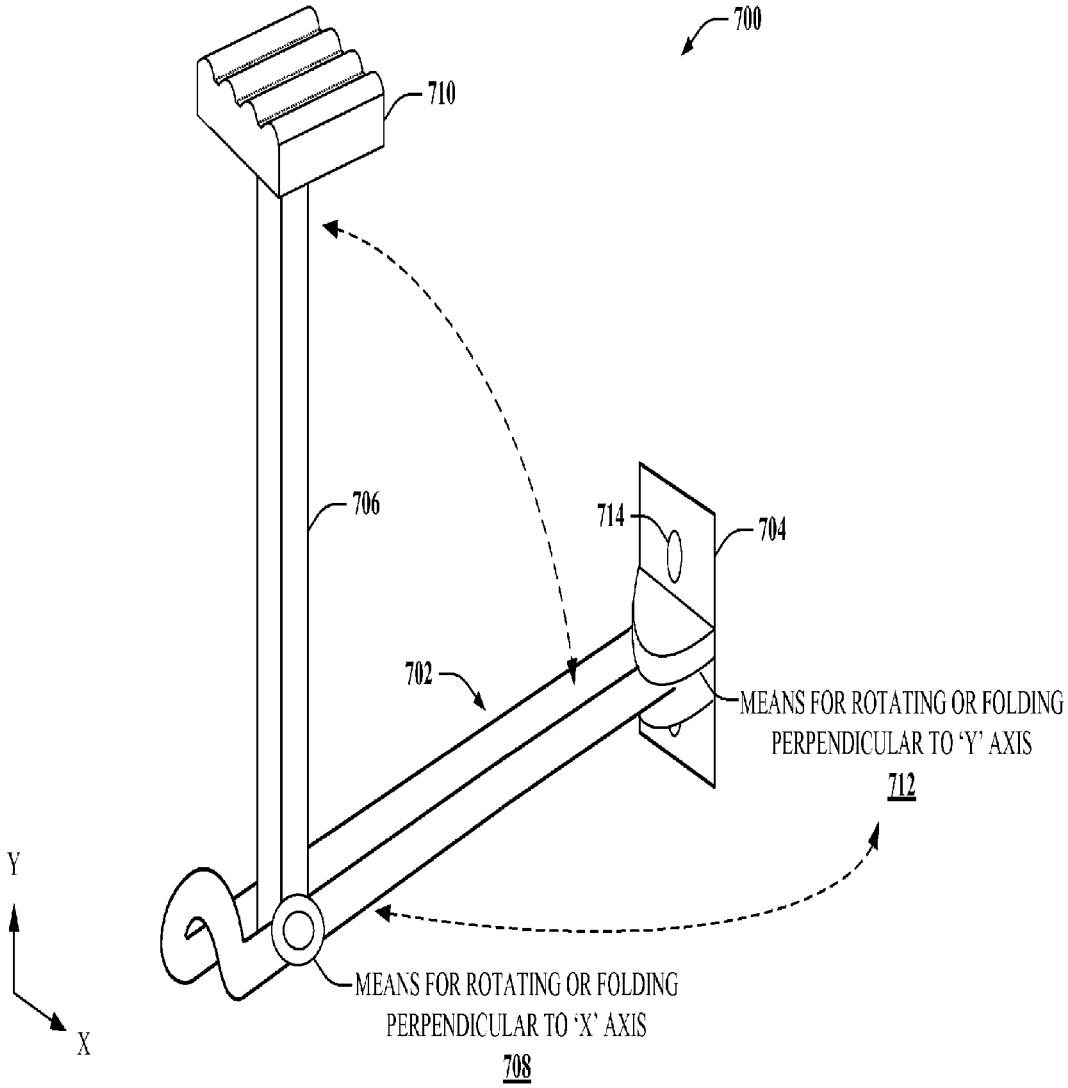
FIG. 7 depicts a diagram of a sample sports apparel organizer adapted to be folded or rotated for compact storage according to still other aspects.

FIG. 7 illustrates a diagram of an apparatus 700 for organizing or storing sports apparel according to still other aspects of the subject disclosure. Apparatus 700 can comprise an extension arm 702 connected at a first end thereof to a mounting device 704, which can be adapted to secure apparatus 700 to a surface. Additionally, extension arm 702 can be connected at a second end thereof to a mounting arm 706 and a padded seat 710 adapted to hold or secure a helmet, as described herein. In at least one aspect of the subject disclosure, extension arm 702 can be secured to mounting arm 706 via a means for rotating (or folding) 708 that enables mounting arm 706 to rotate upward or downward toward or away from extension arm 702, perpendicular to the 'X' axis depicted in FIG. 7. Means for rotating 708 can comprise a screw(s), pines), ball bearing, or other suitable mechanism that enables mounting arm 706 to rotate about an attachment point with extension arm 702. In at least one aspect of the subject disclosure, padded seat 710 can be removed to facilitate rotating mounting arm 706 parallel or substantially parallel (e.g., within five degrees of parallel) to extension arm 702. In another aspect, at least a portion of padded seat 710 is permanent, and acts as a limit to how far mounting arm 706 can be rotated toward extension arm 702 (e.g., twenty degrees or less).

In addition to the foregoing, extension arm can be connected to mounting device 704 via a means for rotating (or folding) 712 extension arm 702 perpendicular to the 'Y' axis of FIG. 7. Means for rotating 712 can facilitate rotating extension arm 702 parallel or substantially parallel (e.g., within five or ten degrees) to a surface to which mounting device 704 is attached. To this end, mounting device 704 comprises a means of attachment 714, suitable for securely fastening mounting device 704 to the surface. Means of attachment 714 can comprise one or more holes for fasteners (e.g., screws, bolts, nails, etc.), tape, glue or other suitable adhesive, one or more clamps, or the like. Means for rotating 712 can be substantially similar to means for rotation 708 in one aspect of the subject disclosure. In another aspect, however, means for rotating 712 can be a distinct rotating mechanism. For instance, means for rotating 712 can include an upper and lower channel attached to or fabricated as part of mounting device 704. Extension arm can fit between the upper and lower channel, secured thereto by a pines), screw(s), ball bearing(s), or other suitable attachment mechanism, that enables extension arm 702 to rotate toward or away from the surface connected to mounting device 704. Although means for rotating 712 is depicted as enabling extension arm 702 to rotate toward the surface in one direction (out from the figure, along the positive 'X' axis), it should be appreciated that means for rotating 712 can instead enable extension arm 702 to rotate in an opposite direction (into the figure, in the negative 'X' direction), or a combination thereof.

What has been described above includes examples of aspects of the claimed subject matter. It is, of course, not possible to describe every conceivable combination of components or methodologies for purposes of describing the claimed subject matter, but one of ordinary skill in the art may recognize that many further combinations and permutations of the disclosed subject matter are possible. Accordingly, the disclosed subject matter is intended to embrace all such alterations, modifications and variations that fall within the spirit and scope of the appended claims. Furthermore, to the extent that the terms "includes," "has" or "having" are used in either the detailed description or the claims, such terms are intended to be inclusive in a manner similar to the term "comprising" as "comprising" is interpreted when employed as a transitional word in a claim.

What is claimed is:

1. An apparatus, comprising:

a mount for securing the apparatus to a surface, the mount comprising at least one substantially planar portion having a plurality of fastener holes;

a mounting arm adapted to support a headware;

an extension arm connected at one end to the mount and connected near a second end to the mounting arm, the extension arm supports the mounting arm at least four inches from the mount, the mounting arm being fixed in position along a length of the extension arm at least at the connection between the extension arm and the mounting arm; and an extension stud that protrudes out from a junction of the mounting arm and the extension arm, in a direction away from a plane perpendicular to the extension arm and on a side of the plane that is away from the mount; wherein:

the extension arm comprises two substantially parallel portions each at least one eighth inch thick that are non-detachably secured at the first end of the extension arm to the mount.

2. The apparatus of claim 1, wherein the extension arm is connected to the mount surface via a pivot device, the pivot device adapted to rotate the extension arm, mounting arm and extension stud between a first position substantially parallel to the surface, and a second position substantially perpendicular to the surface.

3. The apparatus of claim 1, wherein the mounting arm is of variable length.

4. The apparatus of claim 3, wherein the mounting arm comprises a first hollow portion and a second portion, the first portion adapted to contain and secure at least a subset of the second portion, wherein the second portion supports the headware.

5. The apparatus of claim 4, wherein the first portion comprises a set of fastener points adapted to secure the second portion within the first portion at respective lengths along the first portion.

6. The apparatus of claim 1, further comprising an air delivery mechanism that moves air to an upper portion of the mounting arm and an interior of the headware.

7. The apparatus of claim 6, the air delivery mechanism comprises an air pump.

8. The apparatus of claim 6, the air delivery mechanism is secured to the apparatus beneath the extension arm.

9. The apparatus of claim 6, further comprising a cap that substantially covers at least a bottom portion of the air delivery mechanism, the cap is comprised of a substantially rigid material.

10. The apparatus of claim 1, further comprising a hanger comprising an arm adapted to suspend the hanger freely below the extension arm.

11. The apparatus of claim 10, the hanger comprising a plurality of hooks beneath the arm of the hanger adapted to support a device.

12. The apparatus of claim 11, the plurality of hooks extend outward from a length of the arm of the hanger.

13. The apparatus of claim 11, the plurality of hooks are secured to the arm of the hanger by a rotating apparatus adapted to modify an angle between a length of the arm of the hanger and a length of at least one of the plurality of hooks.

14. The apparatus of claim 13, the rotating apparatus comprising a flexible spring adapted to provide resistance to a decrease in the angle in response to a pressure applied to the at least one of the plurality of hooks.

15. The apparatus of claim 11, the plurality of hooks adapted to suspend a bicycle on the hanger.

16. The apparatus of claim 1, wherein the mounting arm is connected to the extension arm by a pivot device, the pivot device being configured to facilitate rotation of the mounting arm about the connection between the extension arm and mounting arm.

* * * * *